United States Patent [19]

Schroeder

[11] 4,013,426

[45] Mar. 22, 1977

[54] REMOVAL OF SULFUR FROM CARBONACEOUS FUEL

[76] Inventor: Wilburn C. Schroeder, 7316 Radcliffe Drive, College Park, Md. 20740

[22] Filed: Mar. 5, 1975

[21] Appl. No.: 555,405

Related U.S. Application Data

[63] Continuation of Ser. No. 426,039, Dec. 18, 1973, abandoned.

[52] U.S. Cl. ..... 44/1 R; 201/17; 423/220; 423/237

[51] Int. Cl.[2] ..... C10L 9/10; C10B 57/00

[58] Field of Search ..... 201/17; 44/1 R; 423/220, 237, 359, 572, 648

[56] References Cited

UNITED STATES PATENTS

| | | | |
|---|---|---|---|
| 2,717,868 | 9/1955 | Gorin et al. | 201/17 |
| 2,726,148 | 12/1955 | McKinley et al. | 44/1 R |
| 3,272,721 | 9/1966 | Loevenstein | 201/17 X |
| 3,736,233 | 5/1973 | Sass et al. | 201/17 |

*Primary Examiner*—Carl F. Dees
*Attorney, Agent, or Firm*—Bacon & Thomas

[57] ABSTRACT

The sulfur content of solid carbonaceous material, such as coal or lignite, is reduced by feeding said material under recycle gas pressure into a continuous closed pressurized cyclic system operating in the range of about 5 to 30 atmospheres, contacting the coal in a desulfurization zone of the cyclic system with hot hydrogen-containing gases at about 1600° F, removing the desulfurized coal from the resulting gas stream, removing sulfur compounds from the gas stream, and burning a part of the resulting gas stream to supply the hot hydrogen-containing gases for contacting the coal. Hydrogen necessary for the recycle gas stream is generated from the coal in the desulfurization zone. The only input to the system is coal and oxygen. Desulfurized coal, sulfur and excess gases are removed as products.

14 Claims, 1 Drawing Figure

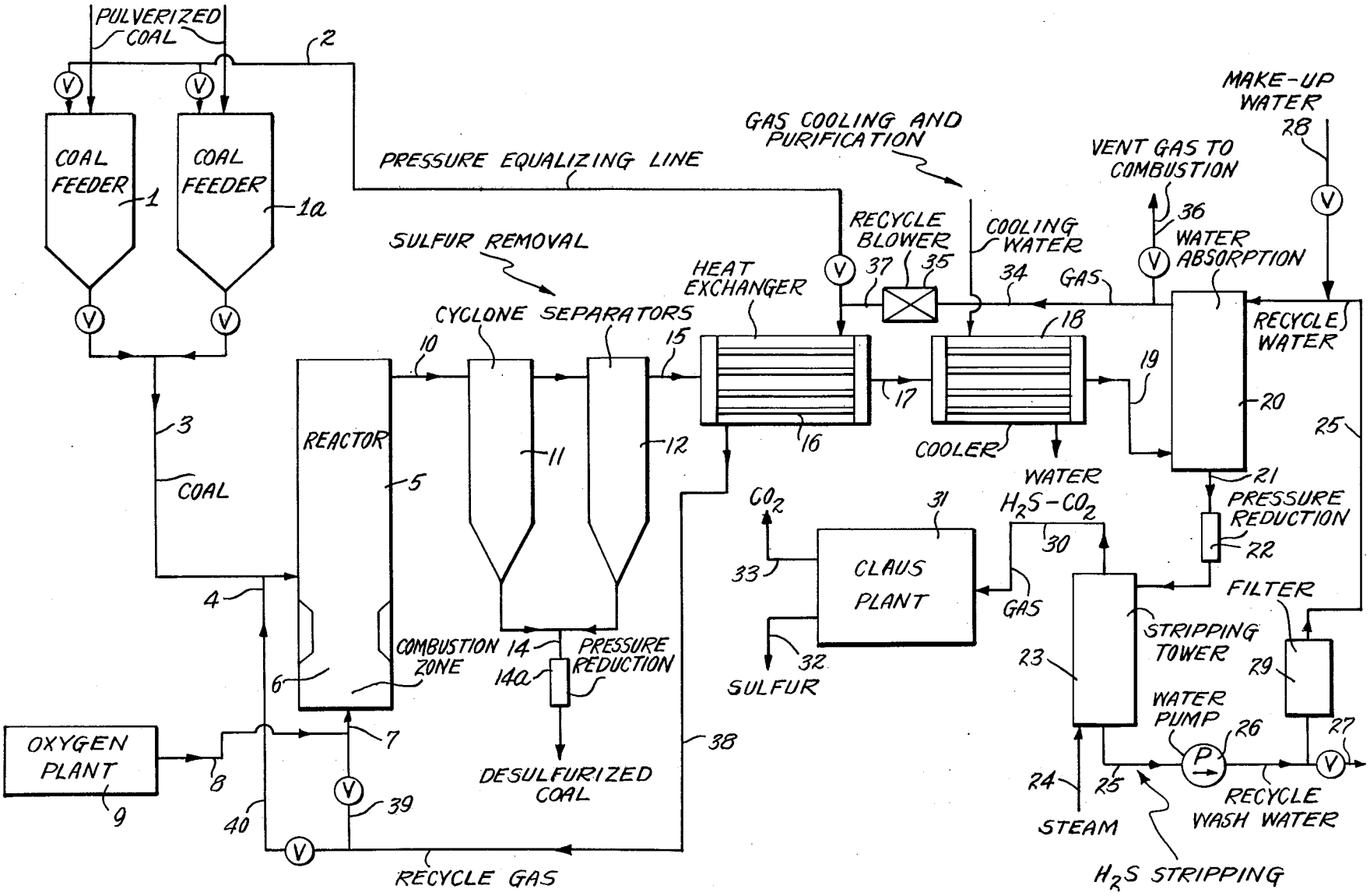
MAKE-UP WATER
28
RECYCLE WATER
25
PRESSURE REDUCTION
22
FILTER
29
27
RECYCLE WASH WATER
WATER ABSORPTION
20
21
STRIPPING TOWER
WATER PUMP
26
H2S STRIPPING
VENT GAS TO COMBUSTION
36
19
GAS
18
WATER H2S-CO2
30
23
24
STEAM
COOLING WATER
34
COOLER
GAS
31
CLAUS PLANT
GAS COOLING AND PURIFICATION
RECYCLE BLOWER
35
37
17
16
CO2
33
32
SULFUR
HEAT EXCHANGER
38
PRESSURE EQUALIZING LINE
15
12
PRESSURE REDUCTION
DESULFURIZED COAL
SULFUR REMOVAL
CYCLONE SEPARATORS
11
14
14a
COMBUSTION ZONE
10
5
REACTOR
7
39
RECYCLE GAS
2
1a
COAL FEEDER
6
40
PULVERIZED COAL
1
COAL FEEDER
3
COAL
4
8
OXYGEN PLANT
9

REMOVAL OF SULFUR FROM CARBONACEOUS FUEL

COPENDING APPLICATION

This application is a continuation of application Ser. No. 426,039, filed Dec. 18, 1973, now abandoned.

This application is related to my copending application Ser. No. 375,013, filed June 29, 1973.

BACKGROUND OF THE INVENTION

This invention relates to the desulfurization of coal and other sulfur containing carbonaceous materials to provide a low sulfur solid carbonaceous product. The product can be burned in industrial or domestic furnaces with production of stack gases which meet pollution regulations regarding sulfur emissions. It can also be used for producing gaseous fuel or the like with less difficulty due to sulfur problems.

I have previously disclosed a process for desulfurizing coal which comprises partially reacting the coal with oxygen and steam at a temperature in the range of about 900° to 1500° F so as to generate nascent hydrogen in contact with the coal.

SUMMARY OF THE INVENTION

The present invention comprises the removal of sulfur from coal or other sulfur-containing materials by contacting the coal in a closed pressurized cyclic system with hot hydrogen-containing recycle gases, a portion of which have been burned with oxygen to provide heat for the desulfurization reaction. No steam is used other than that generated within the system. Coal and oxygen are the only materials fed to the closed cyclic system. Desulfurized coal, sulfur and excess gases are removed as products.

DETAILED DESCRIPTION OF THE INVENTION

Coal is fed at system pressure into a desulfurization zone of a closed cyclic system where it is contacted with the hydrogen-containing recycle gases which are at a temperature sufficiently high to raise the temperature of the coal to about 1100° to 1800° F, preferably 1500° to 1800° F. In this temperature range, a number of reactions occur. Sulfur present in the coal can be in at least three forms, i.e., as pyrites, organic sulfur, and sulfates. The pyrites form iron sulfide and sulfur which react with the hydrogen to form metallic iron and $H_2S$. If steam is present some of the pyrites may be converted to FeO. Organic sulfur compounds are converted by hydrogen into C, CO and $H_2S$. If steam is present it will hydrolyze the organic sulfur compounds into $CO_2$ and $H_2S$. Since there is usually some moisture in the coal fed to the desulfurization zone some steam will necessarily be generated when the coal is contacted with the hot gases.

The equilibrium of the desulfurization reactions toward production of $H_2S$ is strongly favored by high partial pressure of hydrogen or hydrogen-steam in the gases in contact with the coal. Sulfur will be removed from FeS so long as the $H_2S$ is below about 1.8 volume percent of the hydrogen. At this concentration of hydrogen, at the temperatures involved, $H_2S$ will also be formed from the organic sulfur compounds.

The removal of sulfur from the coal can be carried out at atmospheric or higher pressure. However, pressures above atmospheric favor higher reaction rates and better penetration of hydrogen and steam into the coal particles. Because of the small size of the hydrogen molecule it is especially effective in entering the coal. It is preferred to use pressures in the range of about 5 to 30 atmospheres.

Other conditions also favor the use of pressures in the range from 5 to 30 atmospheres. Since the purification train is also at this pressure the volume of gas to be treated is much smaller and the purification process is more effective. Heat exchange equipment is smaller not only because of reduced gas volume, but also because of better heat transfer coefficients.

Even higher pressures, such as 100 atmospheres, could be used but this increases the difficulty of feeding the coal and the problem of discharging it. Vessel wall thicknesses are much greater and the equipment is more costly.

It has been found that the removal of S as $H_2S$ from most coals does not require the generation of hydrogen from coal and steam. The reason for this can be made apparent by reference to the analysis of a typical bituminous coal from the north central part of the United States, which is shown below:

| | | As received | Moisture & Ash Free |
|---|---|---|---|
| $H_2$ | | 5.3 | 6.2 |
| C | | 67.0 | 78.8 |
| N | | 1.4 | 1.6 |
| O | | 7.9 | 9.5 |
| S | | 3.4 | 3.9 |
| Moisture | | 6.1 | — |
| Ash | | 8.9 | — |
| TOTAL | | 100.00 | 100.0 |
| Sulfur Forms | | | |
| As sulfate | 0.37 | | |
| As pyrite | 0.98 | | |
| As organic | 2.07 | | |
| TOTAL | 3.42 | | |

When this coal is heated to a high temperature hydrogen is released and reacts with sulfur to form $H_2S$ and with N to form $NH_3$. At temperatures above 1500° F, in the presence of the large excess of carbon, the hydrogen does not react with oxygen to form water to any considerable extent. Most of the oxygen is removed as CO with a small amount of $CO_2$. Complete reaction of the sulfur and nitrogen to $H_2S$ would require 0.586 lbs of $H_2$ per 100 lbs of moisture and ash free coal. Hydrogen in the coal is 6.2 lbs, of which about ½ to ⅔ is made available by heating the coal, which is about 5 times the amount needed for the reactions shown.

In addition to hydrogen released as elemental hydrogen from the coal, some hydrogen will be formed from the volatile matter in the coal. Temperatures required for desulfurization are high enough to decompose many hydrocarbons to carbon and hydrogen. It should also be noted that while dried coal is fed to the process this normally means coal still containing 3 to 6% water. At high temperature this water will react with carbon and hydrocarbons to produce hydrogen. As heretofore noted, steam generated in or added to the system will also react with sulfur compounds in the coal to form $H_2S$. Steam is therefore effective in removing sulfur from the coal so long as the products of this reaction are carried away by sufficient circulating gas to maintain the concentration of $H_2S$ in the gas below the equilibrium conditions at the existing temperature and pressure. Steam may be added to the system if it is desired to produce more hydrogen in the desulfurizing zone but this addition is not essential to the desulfurization reaction because sufficient hydrogen and steam for this purpose are produced within the closed system.

These various hydrogen producing reactions yield considerably more hydrogen than needed in the desulfurization process and in fact for most coals provide sufficient gas (as a mixture of hydrogen with a low concentration of methane) to allow it to be burned with oxygen to heat the coal, and to furnish some excess gas which can be withdrawn from the process.

The reaction of S with $H_2$ at the temperatures involved, will only go to completion when sufficient $H_2$is present to maintain the $H_2S/H_2$ equilibrium below 1.890% $H_2S$. This is accomplished by removing $H_2S$ from the effluent gases from the desulfurization zone and recycling a sufficient volume of the resulting $H_2$-containing gas through the coal as the $H_2S$ is formed. It is clear, therefore, that most coals can be desulfurized without a separate step to produce $H_2$ gas, but a stream of hydrogen or hydrogen and steam must be circulated through the coal to carry away the $H_2S$ that is formed.

At high temperature C and $H_2$ react to produce methane. At higher temperatures in the temperature range of the invention the equilibrium methane concentration decreases, and at lower temperatures it increases. If the circulating gas contains methane it will tend to suppress further methane formation from carbon and hydrogen, which is desirable. If methane gets too high it lowers the hydrogen partial pressure and tends to reduce the desulfurization reactions. Part of the methane is used in the combustion zone. In addition, build-up of methane in the recycle gases is limited by drawing off a portion of the recycle gases to other uses, either continuously or intermittently.

Volatile matter in bituminous coal is relatively low and generally not over 20%. In subbituminous coal and lignite it may be up to 35 or 40 percent. At 1600° F only about half this volatile matter is driven off in the desulfurization process because of the relatively short retention time. Essentially all the higher hydrocarbons crack to methane, carbon and hydrogen. Some react with steam to form $H_2$ and CO.

For most bituminous coals the methane concentration in the effluent gas from the desulfurization zone is between about 5 and 10%. For subbituminous coal and lignite the methane concentration may be somewhat higher. It is not desirable that the methane concentration in the gas go very much over 10 or 15%. To hold it at this level part of the effluent gases may be removed for other uses as indicated above. There is usually an excess of gas over that required for heat and hydrogen supply.

The invention combines the recycle of hydrogen gas, release of hydrogen from the coal, formation of $H_2S$, and control of equilibrium conditions into a simple, highly effective and economic process for the desulfurization of coal for utility and industrial plants.

Major advantages are:

1. The only material required for the desulfurization of the coal is oxygen;
2. The coal is not changed substantially and can be burned in furnaces and other combustion equipment as it was before desulfurization;
3. Heat loss in the process will be no greater than approximately 10 percent;
4. The sulfur can be recovered as solid sulfur, and does not offer a waste disposal problem;
5. The processing units can be operated to produce more or less desulfurized coal as required by demands for electric power or the desulfurized coal may be stored and used as needed.

The application of the invention for the desulfurization of coal is further illustrated by the accompanying drawing in which:

The sole FIGURE is a flow diagram for a representative desulfurization process.

Coal for the process is dried, crushed or pulverized, and placed in a pressurized hopper 1 or 1*a* (depending on which hopper is on stream). Recycle gas at system pressure from line 2 is used to pressurize the hoppers. Coal is withdrawn from the hopper 1 or 1*a* by means of line 3. The coal flow rate through line 3 may be controlled by a vibratory or screw feeder (not shown). Hot recycle hydrogen gas (containing some methane) may be introduced into line 3 by means of line 4 and the coal and recycle gas are introduced into desulfurization reactor 5.

Heat to bring the coal to operating temperature is supplied by burning recycle hydrogen and methane gas in combustion zone 6 at the bottom of reactor 5. Recycle gas enters the combustion zone 6 from line 7 and is mixed with oxygen entering by line 8 from oxygen plant 9. Oxygen is supplied in excess of that required for complete combustion of the methane and hydrogen supplied to the combustion zone through line 7. The reactions taking place in combustion zone 2 are:

$$2H_2 + O_2 \rightarrow 2H_2O$$

$$CH_4 + 2O_2 \rightarrow CO_2 + 2H_2O$$

Heat released from a gas mixture of 95% $H_2$ and 5% methane is about 304 Btu per scf based on the net heating value.

The hot gases from combustion zone 6 will heat the coal and recycle gas as they enter the desulfurization zone of reactor 5 through line 4. The temperature and volume of the combustion gas must be controlled to give the desired operating temperature in the range of about 1500° to 1800° F.

The volume of gases supplied to reactor 5 is controlled so that the gas velocities through this reactor are sufficient to entrain the coal.

It has been noted that $H_2O$ and $CO_2$ are formed in the combustion zone. The gases will be partly reduced in the desulfurization zone, as follows:

$$C + H_2O \rightarrow CO + H_2$$

$$C + CO_2 \rightarrow 2CO$$

Both reactions are endothermic and require heat. This heat will be supplied by the temperature and volume of the gases entering from the combustion zone 6.

Reactor 5, which encloses the desulfurization and combustion zones, is constructed of steel with a refractory lining. The lining protects the steel from the high temperatures and also serves as an insulator to reduce heat losses.

As the coal is heated in reactor 5 it releases $H_2$ and volatile matter containing methane. Hydrogen released from the coal or present in the gases reacts with the sulfur in the coal to form $H_2S$ and the volume of recycle gases is so controlled that the hydrogen present is in excess of that required to satisfy the $H_2S/H_2$ equilibrium at the existing temperature.

Hydrogen in this zone also reacts with some of the N to form $NH_3$. Little water will be formed from the reaction of $H_2$ and oxygen as the temperature is too high.

Gas velocity, pressure, and retention time in the desulfurization zone of reactor 5 are adjusted to give the desired degree of desulfurization before the coal and gases leave through line 10 and enter cyclone separators 11 and 12.

The desulfurized coal in separators 11 and 12 is hot and may be discharged through line 14 and pressure reduction device 14 to a furnace or other combustion equipment. The energy used in heating the coal is not lost since the sensible heat in the coal is carried to subsequent combustion operations.

The gases separated from the solid in cyclone separators 11 and 12 pass through line 15 to heat exchanger 16. Little or no oils or tars will be separated in the heat exchanger 16, since the operating temperature is high enough to crack these materials to gases. This heat exchanger cools the gases to a temperature between 800° and 900° F.

From heat exchanger 16 the gases flow through line 17 to a cooler 18 where the temperature of the gases is reduced to about 200° F The gases, which comprise hydrogen, methane, carbon monoxide, hydrogen sulfide, carbon dioxide and ammonia, then flow through line 19 to ammonia-water tower 20 which removes $H_2S$ and any $CO_2$ which is present. This tower is operated under system pressure which facilitates adsorption of the $H_2S$ and $CO_2$ from the gases. The rich ammonia solution leaving the bottom of the tower 20 is sent through line 21 and pressure reduction device 22 to stripping tower 23 where the $H_2S$ and $CO_2$ are stripped from the ammonia solution. Steam for stripping is supplied through line 24. The clean ammonia-water solution is recycled to ammonia water wash tower 20 by means of line 25 and pump 26. Part of the solution may be purged from time to time through line 27 to prevent buildup of ammonia and makeup water may be added through line 28. Any solid particles in the solution may be removed in filter 29.

The $H_2S$ and $CO_2$ are sent through line 30 to a Claus plant 31 where the $H_2S$ is converted to liquid or solid sulfur and removed at 32. The $CO_2$ is vented through line 33. Other processes are also available to convert $H_2S$ to sulfur as is well known in the art.

This method of removing $H_2S$ and some $CO_2$ in the gases is adapted to the coal desulfurization plant since the gases also contain $NH_3$ (from the nitrogen in the coal reacting with hydrogen), which can be recovered and used in the washing process.

Gases containing mostly hydrogen and some methane, e.g., 5 to 15%, leave ammonia-water wash 20 through line 34 to recycle blower or compressor 35 where the pressure is restored to initial system pressure. It will be noted that pressure has been maintained through the system from reactor 5 through adsorption tower 20 and that the only pressure loss comes from flow of gas through lines and various treating units. In general, this will be less than 30 psi. Excess sulfur-free gas is vented through line 36 to heating or other uses. A portion of the cooled sulfur-free gases, after recompression by blower 35, is used to pressurize the coal feed hoppers 1 and 1*a* by means of pressure equilizing line 2.

The major portion of the gases from the recycle blower 35 pass through line 37, are preheated to a temperature of about 800° F by passing through heat exchanger 16 and is recycled to the system through line 38. The major portion of the gases from line 38 is passed through line 39 to line 7 which enters the bottom of reactor 5 for burning with oxygen in the combustion zone 6 to supply heat for the desulfurization reaction.

Part of the hot hydrogen-methane-containing recycle gas in line 38 is drawn off through line 40 and is used for direct introduction with the coal into reactor 5 through line 4. By suitably controlling the volumes of recycle gas in lines 39 and 40 the temperature, hydrogen partial pressure and gas velocity in the reactor 5 can be adjusted to provide the operating conditions described above.

The selected temperature of operation in the desulfurization zone depends upon the coal, pressure of operation, and retention time. In general it will be between 1100° and 1800° F.

The process gasifies a small amount of coal varying from about 75 to 200 lbs per ton of coal fed, based on dried coal to the process.

Oxygen use is small, amounting to about 2000 to 3000 scf per ton of dried coal.

The heat efficiency is high and is about 90 percent when the desulfurized coal product is burned without loss of sensible heat.

For a 1000 MW electric plant which requires about 6 tons of bituminous grade coal a minute, the desulfurization can be carried out in 2 to 6 towers depending on pressure, temperature, and amount of sulfur in the coal.

The process operates on bituminous or subbituminous coal or lignite. Coking or non-coking coals can be fed directly to the desulfurizer without pretreatment.

The process described above is intended specifically for the removal of sulfur from coal by reacting it with hydrogen to produce $H_2S$. It has also been noted that some or essentially all of the nitrogen in the coal reacts with hydrogen to produce $NH_3$. This ammonia is removed from the gas stream in the ammonia water wash which removes $CO_2$ and $H_2S$. The ammonia concentration in this solution is controlled by removing part of the solution and adding make-up water. Ammonia can be recovered from withdrawn solution if desired.

Nitrogen removal from coal by hydrogenation shows considerable variation between coal types which is not fully understood. For some coals the nitrogen is reduced to a low level, while others show only a small reduction.

Removal of nitrogen from the coal reduces the emission of nitrogen oxides from utility or industrial plants. It is intended that this invention may be used for nitrogen reduction for coals wherein it is effective.

The desulfurization process described is operated with coal entrained in the gas stream as it passes through the desulfurization zone. This desulfurization process also operates in a satisfactory manner with fluid beds which can be used as an alternate to entraining the coal in the gas stream.

I claim:

1. A process for desulfurizing coal comprising feeding crushed or pulverized coal at ambient temperature into a single desulfurization zone of a closed pressurized cyclic system, contacting the coal in said desulfurization zone with recycled hydrogen-containing gases and with burned recycle gases which provide sufficient heat to raise the temperature of the coal to a temperature within the range of about 1100° F to 1800° F thereby causing release of hydrogen from the coal, cracking of hydrocarbons in the coal to form hydrogen and methane and conversion of the sulfur compounds in the coal by reaction with part of the hydrogen in contact with the coal to form hydrogen sulfide, separating the desulfurized coal from the resulting hydrogen, methane and hydrogen sulfide containing gases, removing hydrogen sulfide from said gases, recycling a portion of the purified hydrogen and methane-containing gases to said desulfurization zone, introducing oxygen from an air separation plant into another portion of said purified hydrogen and methane gases and burning said gases with said oxygen to provide said burned recycle gases, and introducing the resulting burned recycle gases into said desulfurization zone to supply sufficient heat to raise the temperature of the coal to a temperature within said range, essentially the sole reactants fed to the system being coal and oxygen.

2. The process of claim 1 in which the temperature in the desulfurization zone is maintained between 1500° and 1800° F.

3. The process of claim 1 in which the volume of purified hydrogen-containing recycle gases supplied directly to the coal, in combination with the hydrogen supplied by the coal, is sufficient to keep the $H_2S$ in the gases in contact with the coal below 1.8 volume percent of the hydrogen.

4. The process of claim 1 in which the burning of a portion of the recycled gases takes place in a combustion zone separate from the desulfurization zone and the gases from the combustion zone are contacted with the coal in the desulfurization zone along with recycle gases which have not been subjected to combustion.

5. The process of claim 1 in which the pressure in the closed cyclic system is maintained in the range of about 5 to 30 atmospheres.

6. The process of claim 1 in which the coal under system pressure is introduced together with a portion of the unburned recycle gases into the desulfurization zone and is contacted therein with hot burned recycle gases.

7. The process of claim 1 in which the coal is entrained in the desulfurization zone in the contacting gases.

8. The process of claim 1 in which nitrogen in the coal is converted to ammonia and in which ammonia is removed from the effluent gases.

9. The process of claim 1 in which the purified recycle gases contain up to 15% by volume of methane.

10. The process of claim 4 in which the portion of the recycle gases which is burned is burned with excess oxygen to substantially completely convert this portion of the recycle gases to steam and carbon dioxide.

11. The process of claim 1 in which hydrogen sulfide is removed from the recycle gases by contacting the gases with water under system pressure.

12. The process of claim 1 in which ammonia is formed in the desulfurization zone by reaction of hydrogen with nitrogen in the coal and in which ammonia and $H_2S$ are removed from the recycle gases by contacting the gases with water under system pressure.

13. The process of claim 1 in which steam is added to the system to generate additional hydrogen in the desulfurization zone.

14. A process for desulfurizing coal comprising introducing crushed or pulverized coal and recycle gases which contain essentially hydrogen and from 5% to 15% of methane into a single desulfurization zone of a closed cyclic system maintained under a pressure of from about 5 to 30 atmospheres, contacting the coal and recycle gases in said desulfurization zone with combustion gases containing steam and $CO_2$ resulting from burning recycle gases with excess oxygen in a combustion zone of the closed system, the volume and temperature of the combustion gases being sufficient to maintain a temperature of from 1500° F to 1800° F in said reaction zone, whereby $H_2S$ is formed from the sulfur in the coal and hydrogen and methane are formed by cracking of the hydrocarbons of the coal, the volume of recycle gases introduced with the coal being sufficient in combination with the hydrogen released or formed from the coal to dilute the $H_2S$ content of the gases in contact with the coal to less than 1.8% by volume percent of the hydrogen in said gases, separating the desulfurized coal from the resulting gas stream, removing $H_2S$ from the gas stream at system pressure, recycling at least a portion of the purified gases to the respective coal contacting and combustion zones, introducing oxygen into said combustion zone in an amount in excess of that required to convert the hydrogen and methane of the recycle gases introduced into this zone to steam and $CO_2$, the amount of oxygen being no more than about 3000 scf per ton of coal and essentially the sole reactants fed to said system being coal and oxygen, burning the recycle gases introduced into the combustion zone with said excess oxygen in said combustion zone and introducing the resulting hot combustion gases into said desulfurization zone.

* * * * *